US009022374B1

(12) United States Patent
Baryam

(10) Patent No.: US 9,022,374 B1
(45) Date of Patent: May 5, 2015

(54) ROCKING JAW GRIPPER FOR RESTRAINING TUBULARS

(75) Inventor: Jacob Baryam, Houston, TX (US)

(73) Assignee: Scorpion Oil Tools, Inc., Houston, TX (US)

( * ) Notice: Subject to any disclaimer, the term of this patent is extended or adjusted under 35 U.S.C. 154(b) by 834 days.

(21) Appl. No.: 13/302,587

(22) Filed: Nov. 22, 2011

(51) Int. Cl.
*B25B 1/22* (2006.01)
*B25B 5/10* (2006.01)
*B25B 5/00* (2006.01)

(52) U.S. Cl.
CPC .. *B25B 5/105* (2013.01); *B25B 5/00* (2013.01)

(58) Field of Classification Search
CPC ..... B25B 5/12; B25B 5/04; B25B 5/067; B25B 5/082; B25B 5/125; B25B 3/00
USPC ..... 269/94, 3, 6, 143, 249, 95; 29/270, 278, 29/276
See application file for complete search history.

(56) References Cited

U.S. PATENT DOCUMENTS

| | | | | |
|---|---|---|---|---|
| 823,611 | A * | 6/1906 | Martin | 269/5 |
| 2,865,240 | A * | 12/1958 | Kniser | 269/6 |
| 5,906,034 | A * | 5/1999 | Weisshaar | 29/257 |
| 8,322,697 | B2 * | 12/2012 | Lin | 269/42 |
| 8,499,436 | B2 * | 8/2013 | Shen | 29/724 |
| 2012/0151727 | A1 * | 6/2012 | Dewell | 29/237 |
| 2012/0204393 | A1 * | 8/2012 | Gentner et al. | 29/257 |

* cited by examiner

*Primary Examiner* — Lee D Wilson
(74) *Attorney, Agent, or Firm* — Buskop Law Group, PC; Wendy Buskop

(57) ABSTRACT

A rocking jaw gripper for restraining tubulars including an arm with a rocking jaw gripper rocker jaw, a rocking jaw gripper frame connected with the arm, a locking pin connecting the rocking jaw gripper frame to the chain cylinder, a hinge pin connecting the rocking jaw gripper frame to the arm and a plate jaw fastener retaining the rocker jaw body between the top plate and the bottom plate by engaging the tail hole of the rocker jaw body. When the rocking jaw gripper is engaged, it acts to restrain the movement of a tubular during make-up and break-out.

15 Claims, 14 Drawing Sheets

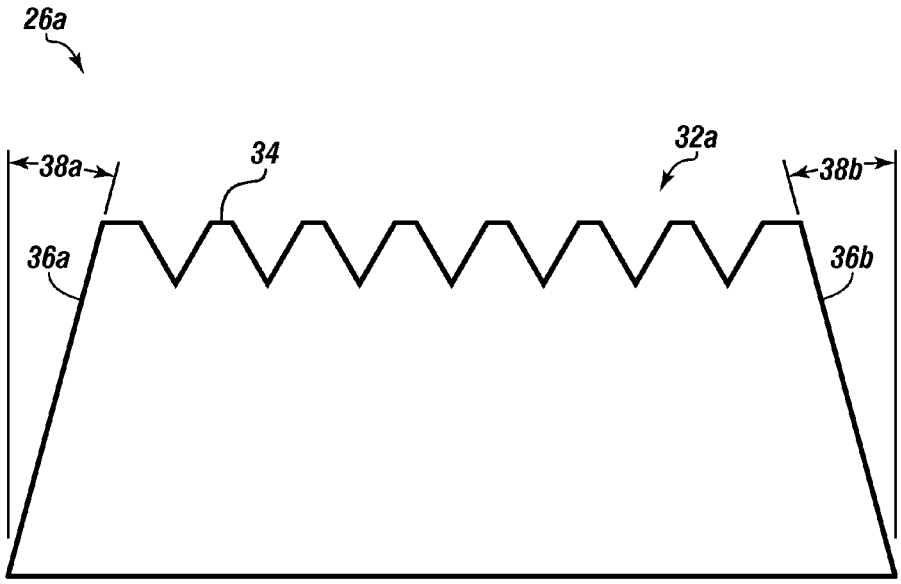
FIGURE 8B
FIGURE 8C
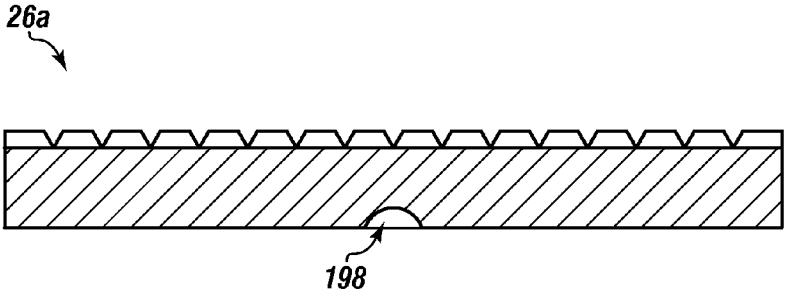

ROCKING JAW GRIPPER FOR RESTRAINING TUBULARS

FIELD

The present embodiments generally relate to a rocking jaw gripper for restraining a tubular, such as with a tong assembly.

BACKGROUND

A need exists for a rocking jaw gripper for restraining a tubular that is easily adjustable.

A further need exists for a tool that can break-out or make-up a tubular in high altitudes or extreme environments, such as underwater.

A further need exists for a tool that can break-out or make-up a tubular in minutes instead of hours, reducing downtime of wells or other devices.

The present embodiments meet these needs.

BRIEF DESCRIPTION OF THE DRAWINGS

The detailed description will be better understood in conjunction with the accompanying drawings as follows:

FIG. 8B depicts a close up view of a tong die according to one or more embodiments.

FIG. 8C depicts a cut view of the tong die according to one or more embodiments.

Figure 1A:
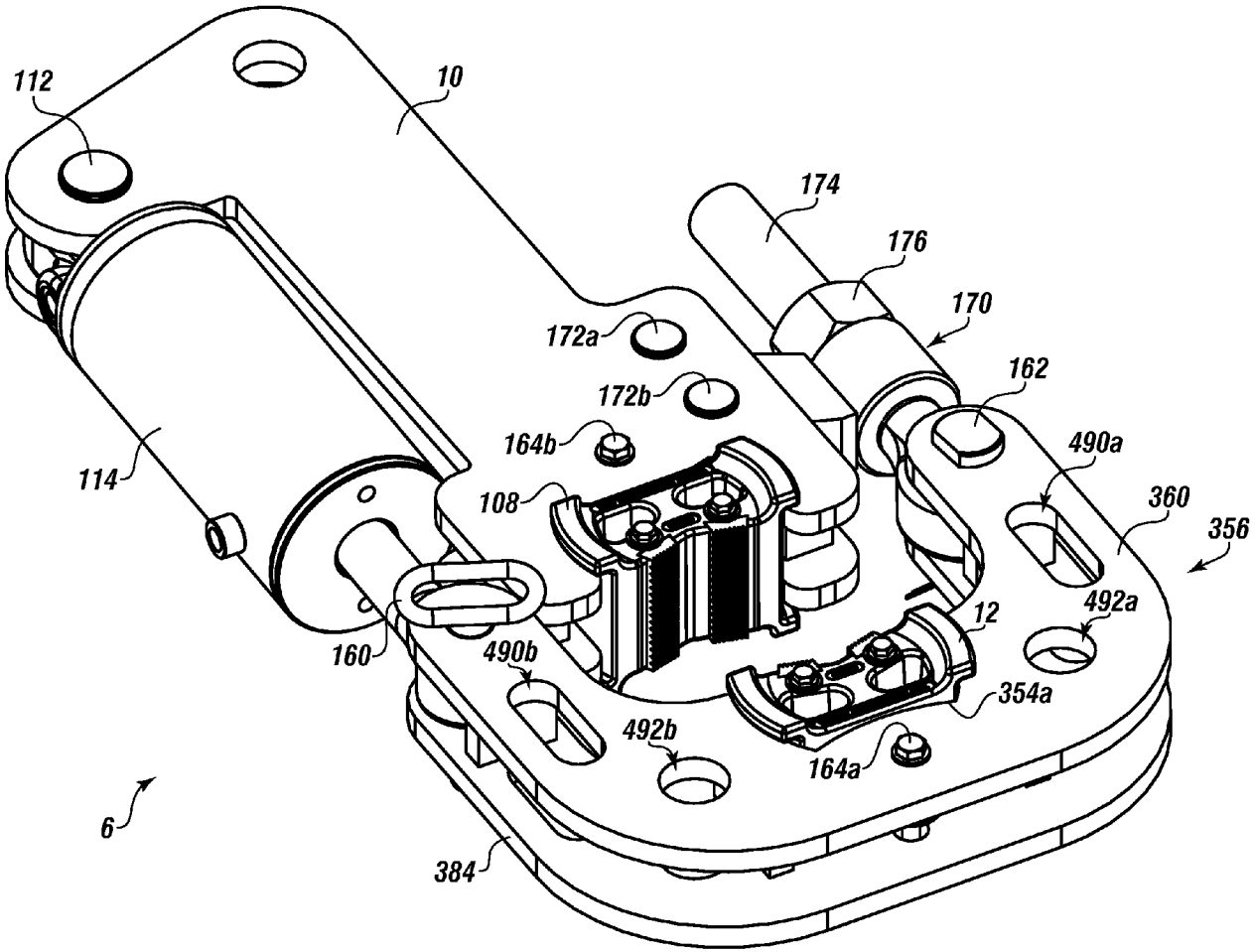
FIG. 1A depicts a rocking jaw gripper with an adjuster link for restraining tubulars according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a rocking jaw gripper for restraining tubulars.

The rocking jaw gripper can have an automated make-up or break-out procedure, eliminating the loss of extremities due to injury from manual tongs.

The rocking jaw gripper can be extremely compact in comparison to the prior art, allowing for make-up and break-out in small enclosed areas, such as mines.

The assembly can prevent work slows by replacing manual tongs, leading to overall employment growth. The tong assembly can prevent layoffs or employee replacement by preventing injuries that can require hospitalization.

The rocking jaw gripper can have a design which internally dissipates energy, which can prevent violent energy releases that can lead oil spills.

The assembly can be extremely portable and require little extra equipment, which can allow water well drilling to be done safely.

The rocking jaw gripper can have a specialized design, which can prevent the use of dangerous equipment, not designed for the purpose of make-up or break-out, from being used.

The rocking jaw gripper can include an arm with a rocking jaw gripper rocker jaw, which can have a rocking jaw gripper rocker jaw body.

The rocking jaw gripper rocker jaw body can have a face, which can have tong die grooves. The tong die grooves can have groove edges that incline towards a center line as the groove edges extend from the rocking jaw gripper rocker jaw body.

Each of the tong die grooves can have a tong die. The tong dies can have a tooth bed, which can support one or more teeth. The plurality of teeth can extend from the tooth bed and can be used for gripping tubulars.

Each tooth bed can have tooth bed edges, which can have a slope to provide a flush fit with the groove edges.

Though described and shown with teeth, the tong die does not necessarily have teeth. The tong die used here is envisioned to be any tong die that is available for use in the make-up or break-out of tubulars.

Though the tong die groove is described and shown with an angled tong die groove, the tong die groove does not necessarily have angled grooves. The tong die groove is envisioned as any tong die groove that is available for use in the make-up or break-out of tubulars, such as a T-shaped groove.

The tong die grooves can have a holding means for each tong die, which can provide a holding compression. The holding compression can prevent the tong dies from sliding out of the tong die grooves.

The rocking jaw gripper rocker jaw body can have a first pair of side flanges and a second pair of side flanges extending from the rocking jaw gripper rocker jaw body. Each side flange can be curved and can be configured to prevent deformation during movement.

The rocking jaw gripper rocker jaw body can have a tail extending from the rocking jaw gripper rocker jaw body. The tail can have a tail hole for engaging the arm.

A rocking jaw gripper frame can be connected with the arm. The rocking jaw gripper frame can include a top plate with a top rocker recess.

The top rocker recess can include a first straight edge portion connected with a first concave edge portion. The first concave edge portion can have a first concave edge radius.

The top rocker recess can include a second straight edge portion connected with a second concave edge portion. The second concave edge portion can have a second concave edge radius.

The top rocker recess can include a top convex edge located between the first concave edge portion and the second concave edge portion. The top convex edge can have a top convex edge radius.

The top plate can have a top fastening hole located next to the top rocker recess, such as a top fastening hole for retaining a rocker jaw.

The top plate can have a top plate hinge opening. The top plate hinge opening can be located opposite a top plate locking opening formed in the top plate.

The rocking jaw gripper frame can have a bottom plate with a bottom rocker recess. The bottom rocker recess can include a first bottom straight edge portion connected with a first bottom concave edge portion. The first bottom concave edge portion can have a bottom concave edge radius.

The bottom rocker recess can include a second bottom straight edge portion connected with a second bottom concave edge portion. The second bottom concave edge portion can have a bottom concave edge radius.

The bottom rocker recess can have a bottom convex edge located between the first bottom concave edge portion and the second bottom concave edge portion. The bottom convex edge can have a bottom convex radius.

The bottom plate can have a bottom fastening hole located next to the bottom rocker recess.

The bottom plate can have a bottom plate hinge opening located opposite a bottom plate locking opening.

The bottom plate can have one or more spacing bars separating the top plate and the bottom plate, such as five spacing bars separating the top and bottom plates.

The spacing bars can align the top fastening hole with the bottom fastening hole, align the top plate hinge opening with the bottom plate hinge opening, and align the top plate locking opening with the bottom plate locking opening.

The rocking jaw gripper rocker jaw body can have an outer diameter configured to provide a flush connection between the rocking jaw gripper rocker jaw body and the top rocker recess and the bottom rocker recess.

The rocking jaw gripper frame can have an arm rocker jaw located within the top rocker recess and the bottom rocker recess. The arm rocker jaw can be a substantially identical structure to the rocker jaw.

The arm rocker jaw can have a second face, which can have a second facial radius. The arm rocker jaw can include a holding means. The holding means can be a substantially identical structure to the holding means of the rocking jaw gripper rocker jaw.

The top convex radius and the bottom convex radius can allow for self-centering of the arm rocker jaw in the top rocker recess and the bottom rocker recess.

The rocking jaw gripper frame can have a locking pin connected between the top plate and the bottom plate. The locking pin can hold the rocking jaw gripper frame to the arm.

The rocking jaw gripper frame can have a hinge pin connected between the top plate and the bottom plate. The hinge pin can hold the L-link or the adjuster link to the rocking jaw gripper frame.

The rocking jaw gripper frame can have a plate jaw fastener retaining the rocker jaw body between the top plate and the bottom plate by engaging the tail hole of the rocker jaw body.

The arm can have a plate jaw fastener retaining the rocker jaw body between the top plate and the bottom plate by engaging the tail hole of the rocker jaw body.

The rocking jaw gripper can have an adjuster link, which can extend from the arm. The rocking jaw gripper frame can connect with the arm using one or more pins engaging through the adjuster link. A bolt can connect the rocking jaw gripper frame to the adjuster link. The bolt can extend through the adjuster link.

The adjuster link can have an adjuster nut securing the bolt to the adjuster link.

The adjuster link can have at least one aligning set screw, which can be used to maintain an orientation of the bolt in the adjuster link.

The rocking jaw gripper can have the bolt with alignment grooves to allow for aligning the bolt in a proper orientation.

The rocking jaw gripper can have a first pair of side flanges and the second pair of side flanges, which can have bevels at their base that can allow the rocking jaw gripper rocker jaw to move in the rocking jaw gripper frame to hold the tubulars during make up and break down.

The rocking jaw gripper can have a rocking jaw gripper frame, which can connect with the arm via an L-link.

The rocking jaw can have a face, which comprises three parallel tong die grooves and a tong die in each parallel tong die groove. The tong dies can have one or more teeth with a pyramidal shape.

The rocking jaw can have a holding means, such as a detent or a fastener.

The rocking jaw gripper can have a first pair of side flanges and the second pair of side flanges, which are connected with an outside surface of the top plate and the bottom plate or connected with the an inside surface of the top plate and the bottom plate.

The rocking jaw gripper can have at least one gripping hole located in the top plate and the bottom plate.

The rocking jaw gripper can have a locking pin storage hole located through the top plate and the bottom plate for containing the locking pin.

The rocking jaw gripper can have one or more hinge points located on the top plate opposite the top plate locking opening and located on the bottom plate opposite the bottom plate locking opening.

The rocking jaw gripper can have a top plate and bottom plate, which each include one or more locking openings located opposite one or more hinge points.

The rocking jaw gripper can have a top plate and bottom plate, which each include one or more locking points located opposite the top plate hinge opening and the bottom plate hinge opening.

The rocking jaw gripper can include at least two handles mounted to the rocking jaw gripper.

The rocking jaw gripper can have a rocker jaw body, which includes a first body cavity and a second body cavity extending from a top side into the rocker jaw body.

The rocking jaw gripper can have a rocker jaw body, which includes a third body cavity and a fourth body cavity extending from a bottom side into the rocker jaw body.

The rocking jaw gripper can have a tong die, which includes a depression in a back side for containing the holding means, such as a spring and ball which slides into the depression.

Turning now to the Figures, FIG. 1A depicts a rocking jaw gripper 6 with an adjuster link 170 for restraining tubulars according to one or more embodiments.

The rocking jaw gripper 6 can include a rocking jaw gripper arm 10 connected with an adjustable gripping frame 356. The rocking jaw gripper arm 10 can be connected to the rocking jaw gripper frame 356 with the adjuster link 170, creating the adjustable version of the rocking jaw gripper 6.

The rocking jaw gripper arm 10 can be connected with an arm rocker jaw 108. The arm rocker jaw 108 can connect with the rocking jaw gripper arm using the plate jaw fastener 164*b*.

The adjuster link 170 can extend from the rocking jaw gripper arm 10. The adjuster link 170 can connect with the rocking jaw gripper arm 10 via one or more pins 172*a* and 172*b* engaging through the adjuster link 170.

A bolt 174 can connect the adjustable gripping frame 356 to the rocking jaw gripper arm 10. The bolt 174 can be connected to the adjustable gripping frame 356 with a hinge pin 162. The bolt 174 can extend through the adjuster link 170 and can be held in place by an adjuster nut 176.

The adjustable gripping frame 356 can have a top plate 360 and a bottom plate 384. The adjustable gripping frame 356 can have at least one adjustable gripping hole 490*a* and 490*b*. The adjustable gripping frame 356 can have at least one adjustable locking pin storage hole 492*a* and 492*b*.

The adjustable gripping frame 356 can have an adjustable top rocker recess 354*a* and an adjustable bottom rocker recess, which is not shown in this Figure. The adjustable top rocker recess 354*a* and the adjustable bottom rocker recess can hold a rocking jaw gripper rocker jaw 12. The rocking jaw gripper rocker jaw 12 can be attached to the adjustable gripping frame 356 using a plate jaw fastener 164*a*.

The adjustable gripping frame 356 can be connected to a chain cylinder 114 with a locking pin 160. The chain cylinder 114 can be connected to the rocking jaw gripper arm 10 using a chain cylinder connecting pin 112.

Though depicted here with cylinders as the mechanism for applying force, in one or more embodiments, the force can be applied using a screw mechanism or other manual means.

Figure 1B:
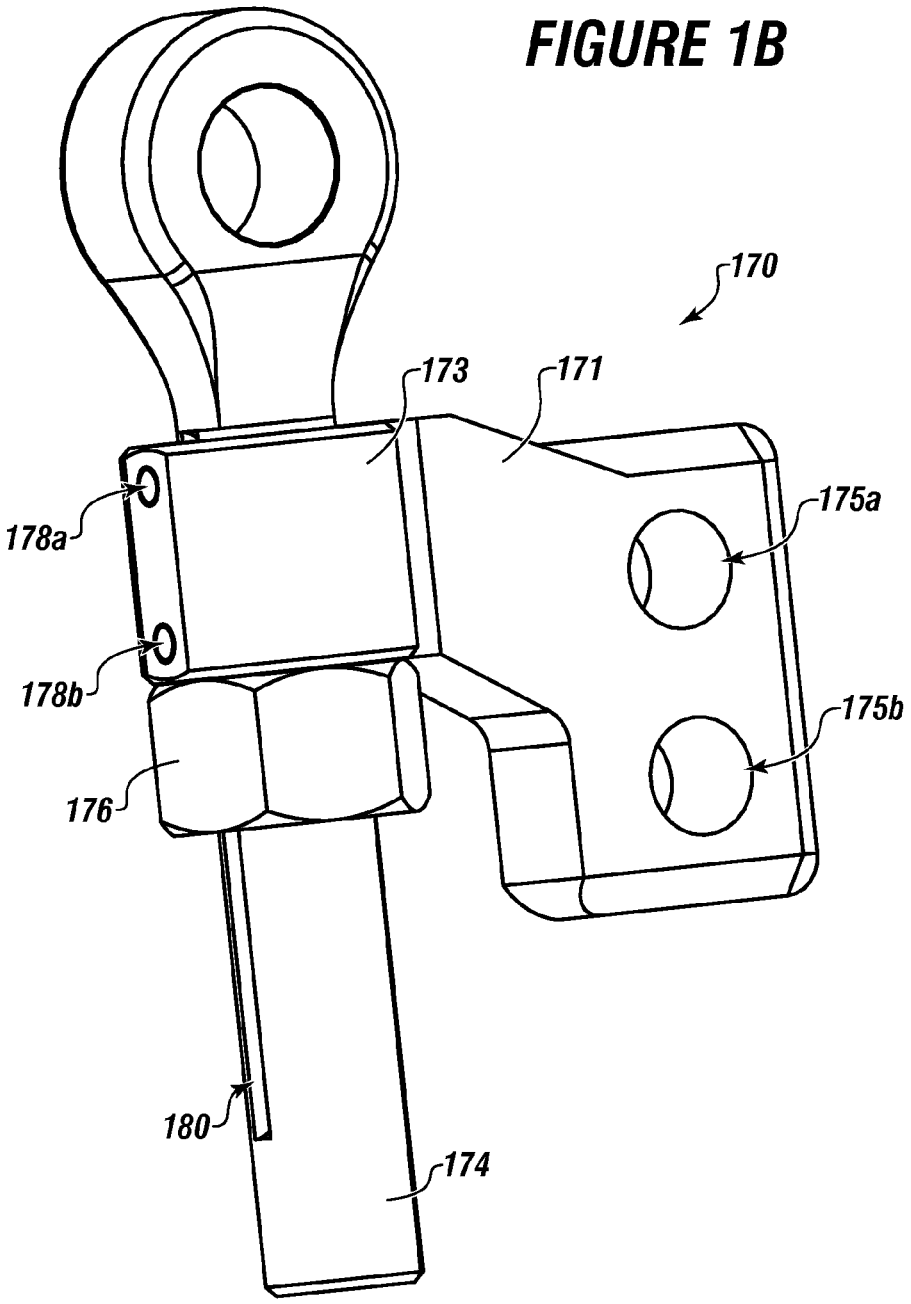
FIG. 1B depicts the adjuster link according to one or more embodiments.

FIG. 1B depicts the adjuster link 170 according to one or more embodiments.

The adjuster link 170 can have an adjuster link bracket 171 which is connected with an adjuster bolt receiving end 173.

The adjuster link bracket 171 can have one or more arm connecter holes 175*a* and 175*b*, for receiving the plurality of pins.

The adjuster bolt receiving end can have at least one aligning set screw 178*a* and 178*b*.

The adjuster bolt receiving end 173 can engage with a bolt 174. An adjuster nut 176 can be engaged with the bolt 174 and in connection with the adjuster bolt receiving end 173.

The bolt 174 can have at least one alignment groove 180. The bolt can be oriented using the one or more aligning set screws 178*a* and 178*b*.

Figure 1C:
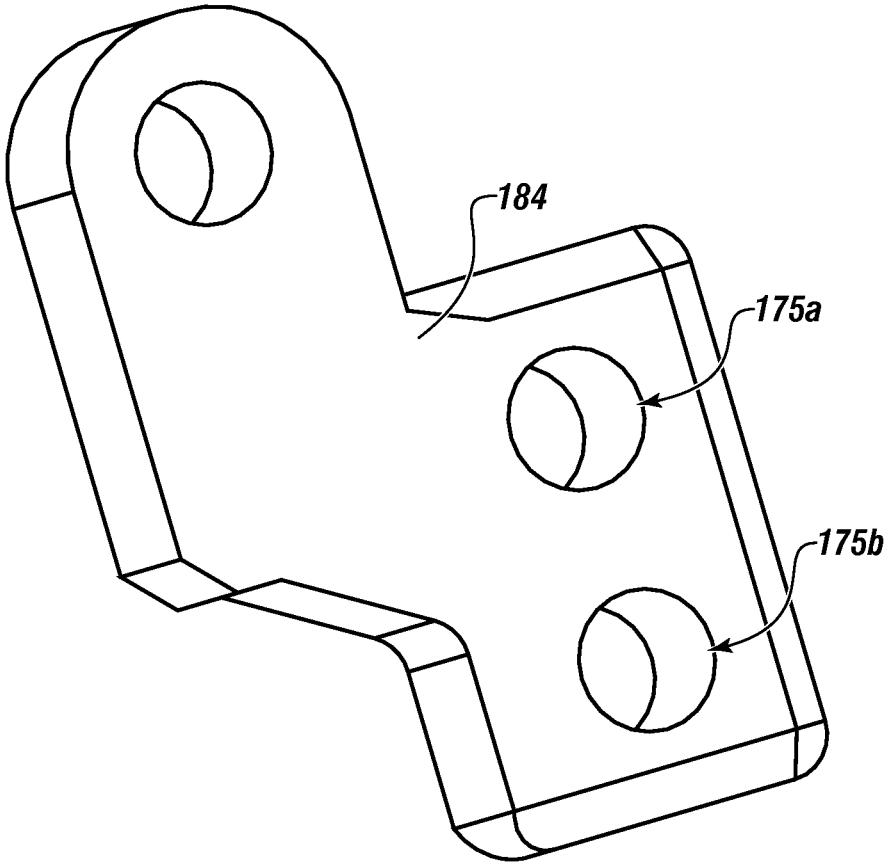
FIG. 1C depicts an L-link according to one or more embodiments.

FIG. 1C depicts an L-link 184 according to one or more embodiments.

The L-link can be connected with the rocking jaw gripper arm in place of the adjuster link, creating a fixed version of the rocking jaw gripper.

The L-link 184 can have one or more arm connecter holes 175*a* and 175*b*, for receiving the plurality of pins.

Figure 2:
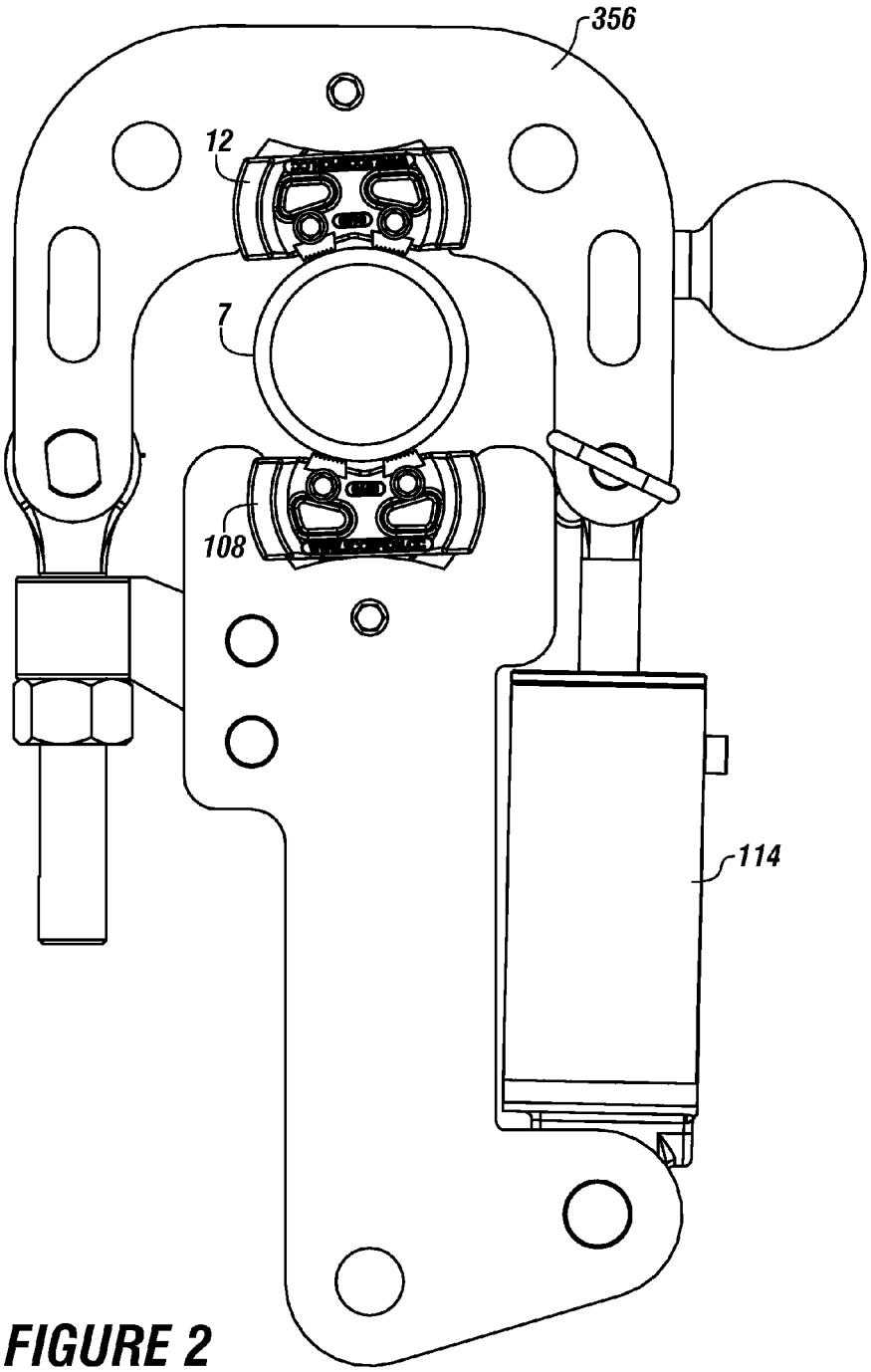
FIG. 2 depicts a top view of the adjustable version of the rocking jaw gripper engaged with a tubular according to one or more embodiments.

FIG. 2 depicts a top view of the adjustable version of the rocking jaw gripper engaged with a tubular according to one or more embodiments.

In operation, the chain cylinder 114 can move the adjustable gripping frame 356 to cause the tubular 7 to be engaged between the rocking jaw gripper rocker jaw 12 and the arm rocker jaw 108.

Figure 3:
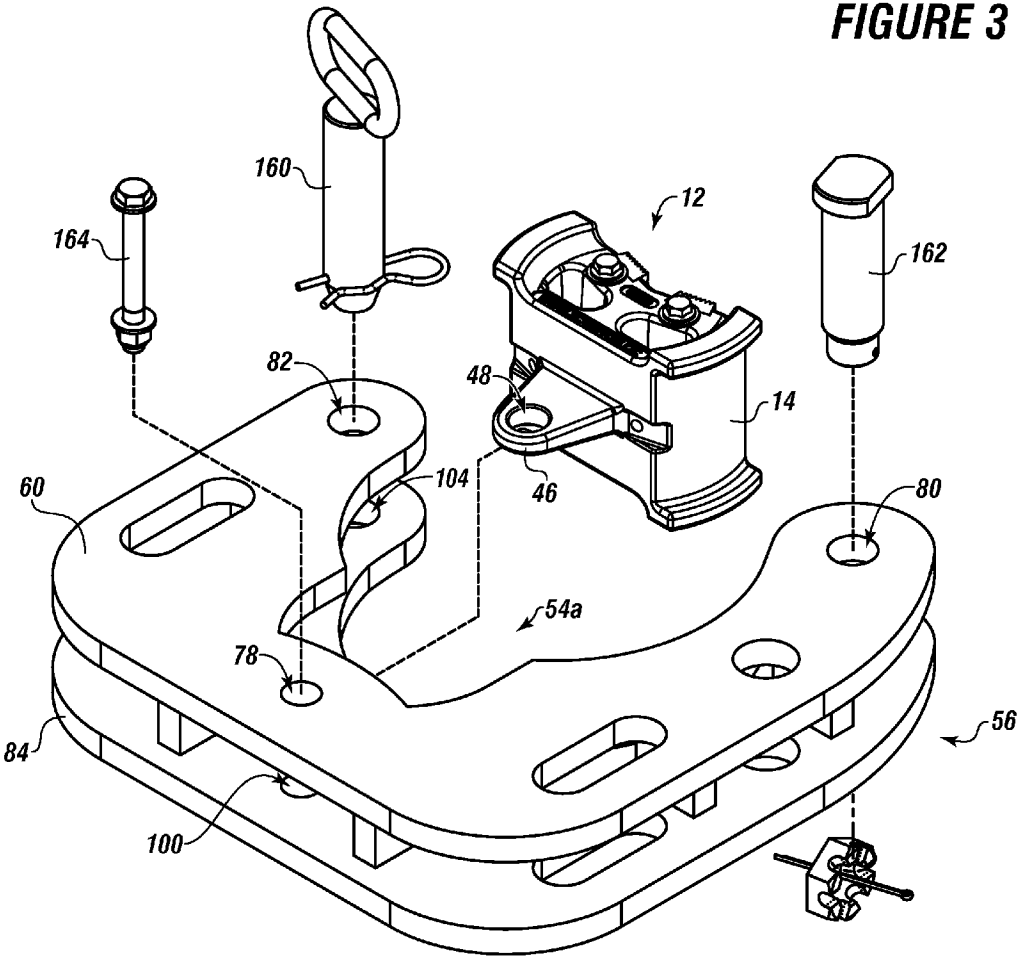
FIG. 3 depicts an overhead view of a disassembled rocker jaw and the fixed gripper frame according to one or more embodiments.

FIG. 3 depicts and overhead view of a disassembled first rocker jaw and a fixed gripper frame according to one or more embodiments.

The rocking jaw gripper rocker jaw 12 can include a tail 46 extending from a rocker jaw body 14. The rocker jaw body 14 can have a flush fit between the rocker jaw body 14 and the fixed top rocker recess 54*a* and bottom rocker recess, which is not shown in this Figure.

The fixed gripper frame 56 can have a fixed top fastening hole 78 disposed through the fixed top plate 60 proximate the fixed top rocker recess 54*a*, and a fixed bottom fastening hole 100 disposed through the fixed bottom plate 84 proximate the fixed bottom rocker recess (not shown in this Figure).

The tail 46 can have a tail hole 48. The plate jaw fastener 164 can engage through the fixed top fastening hole 78, tail hole 48, and fixed bottom fastening hole 100 to connect the rocking jaw gripper rocker jaw 12 with the fixed gripping frame 56; thereby retaining the rocking jaw gripper rocker jaw 12 between the fixed top plate 60 and fixed bottom plate 84.

The fixed top plate 60 can have a fixed top plate hinge opening 80 disposed therethrough, and the fixed bottom plate 84 can have a fixed bottom plate hinge opening (not shown). The fixed top plate hinge opening 80 and the fixed bottom plate hinge opening can receive a hinge pin 162, forming a hinge point.

The fixed top plate 60 can have a fixed top plate locking opening 82, and the fixed bottom plate 84 can have a fixed bottom plate locking opening 104. The fixed top plate locking opening 82 and the fixed bottom plate locking opening 104 can receive the locking pin 160.

One or more embodiments of the rocking jaw gripper can include one or more hinge points disposed on the fixed top plate 60 opposite a fixed top plate locking opening 82, and disposed on the fixed bottom plate 84 opposite the fixed bottom plate locking opening 104. The fixed top plate 60 and fixed bottom plate 84 can each include one or more fixed locking openings disposed opposite the plurality of hinge points, forming one or more locking points.

Figure 4:
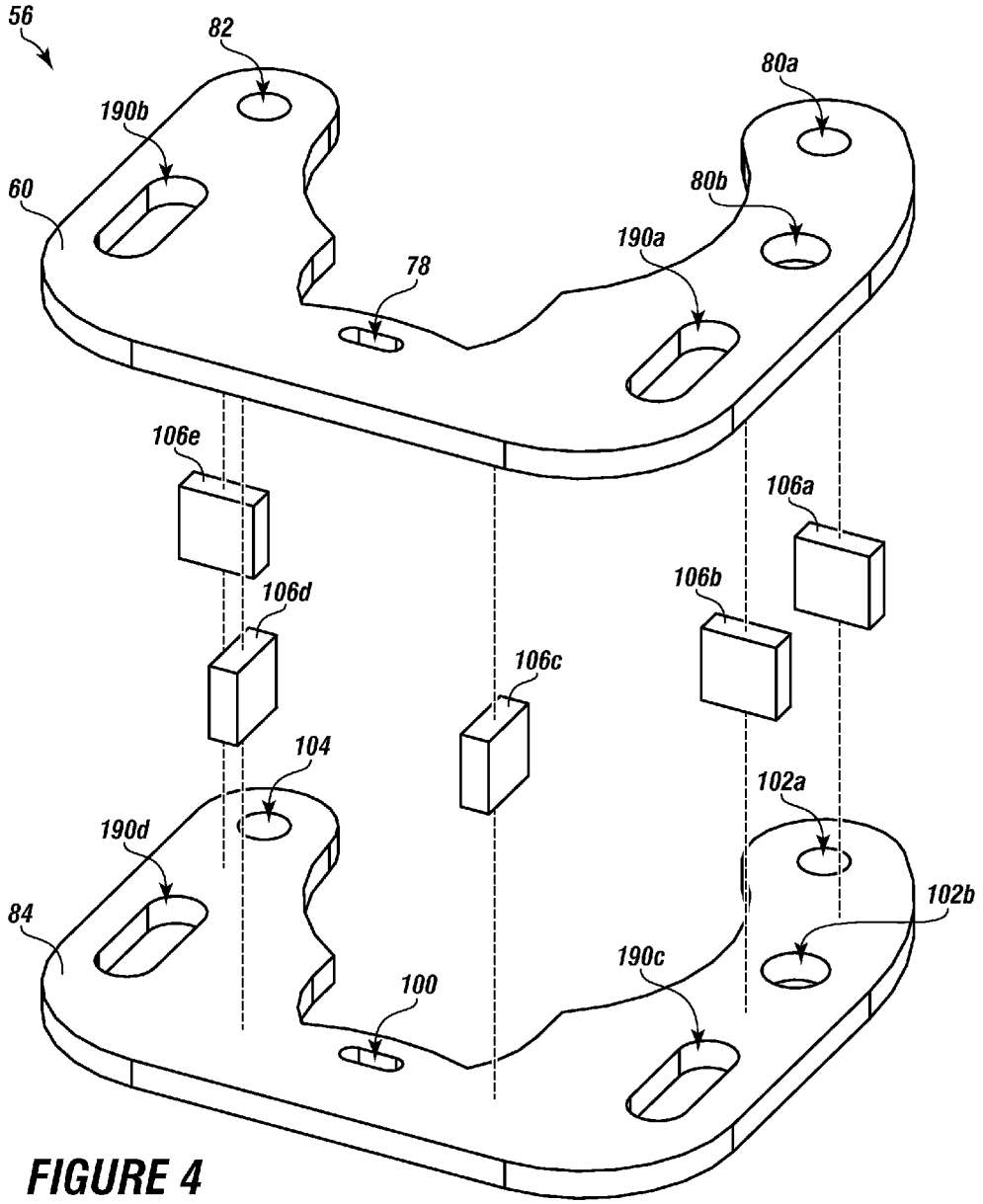
FIG. 4 depicts an exploded view of the fixed gripper frame according to one or more embodiments.

FIG. 4 depicts an exploded view of the fixed gripper frame 56 according to one or more embodiments.

The fixed top plate 60 can have a first fixed top plate hinge opening 80*a* and second fixed top plate hinge opening 80*b* for receiving hinge pins, first fixed gripping hole 190*a* and second fixed gripping hole 190*b*, fixed top plate locking opening 82 for receiving the locking pin, and fixed top fastening hole 78 for receiving the plate jaw fastener.

The fixed bottom plate 84 can have a first fixed bottom plate hinge opening 102*a* and a second fixed bottom plate hinge opening 102*b* for receiving hinge pins, a third fixed gripping hole 190*c* and fourth fixed gripping hole 190*d*, fixed bottom plate locking opening 104 for receiving the locking pin, and fixed bottom fastening hole 100 for receiving the plate jaw fastener.

One or more fixed spacing bars 106*a*, 106*b*, 106*c*, 106*d* and 106*e* can be disposed between the fixed top plate 60 and fixed bottom plate 84 for separating the fixed top plate 60 and fixed bottom plate 84.

The fixed spacing bars 106*a*-106*e* can align the fixed top fastening hole 78 with the fixed bottom fastening hole 100, align the first and second fixed top plate hinge openings 80*a* and 80*b* with the first and second fixed bottom plate hinge opening 102*a* and 102*b*, align the third fixed gripping hole 190*c* and the fourth fixed gripping hole 190*d* with the gripping holes in the fixed top plate 60, and align the fixed top plate locking opening 82 with the fixed bottom plate locking opening 104.

Figure 5A:
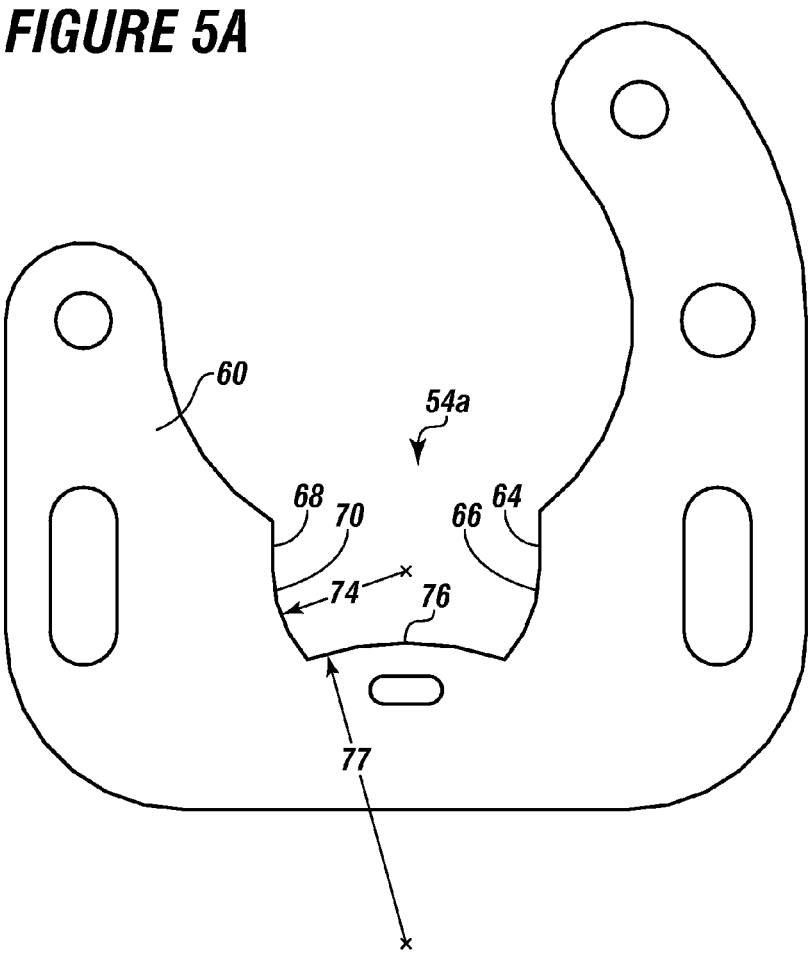
FIG. 5A depicts a top view of the fixed top plate according to one or more embodiments.

FIG. 5A depicts a top view of the fixed top plate according to one or more embodiments.

The fixed top plate 60 can have the fixed top rocker recess 54*a*, which can be configured to receive and retain the rocking jaw gripper rocker jaw.

For example, the fixed top rocker recess 54*a* can have a first fixed top straight edge portion 64 sequentially connected with a first fixed top concave edge portion 66 and a second fixed top straight edge portion 68 sequentially connected with a second fixed top concave edge portion 70.

Each fixed top concave edge portion can have a fixed top concave edge radius 74.

The fixed top rocker recess 54*a* can have a fixed top convex edge 76 disposed between the first fixed top concave edge portion 66 and second fixed top concave edge portion 70 and connected therewith. The fixed top convex edge 76 can have a fixed top convex edge radius 77.

Figure 5B:
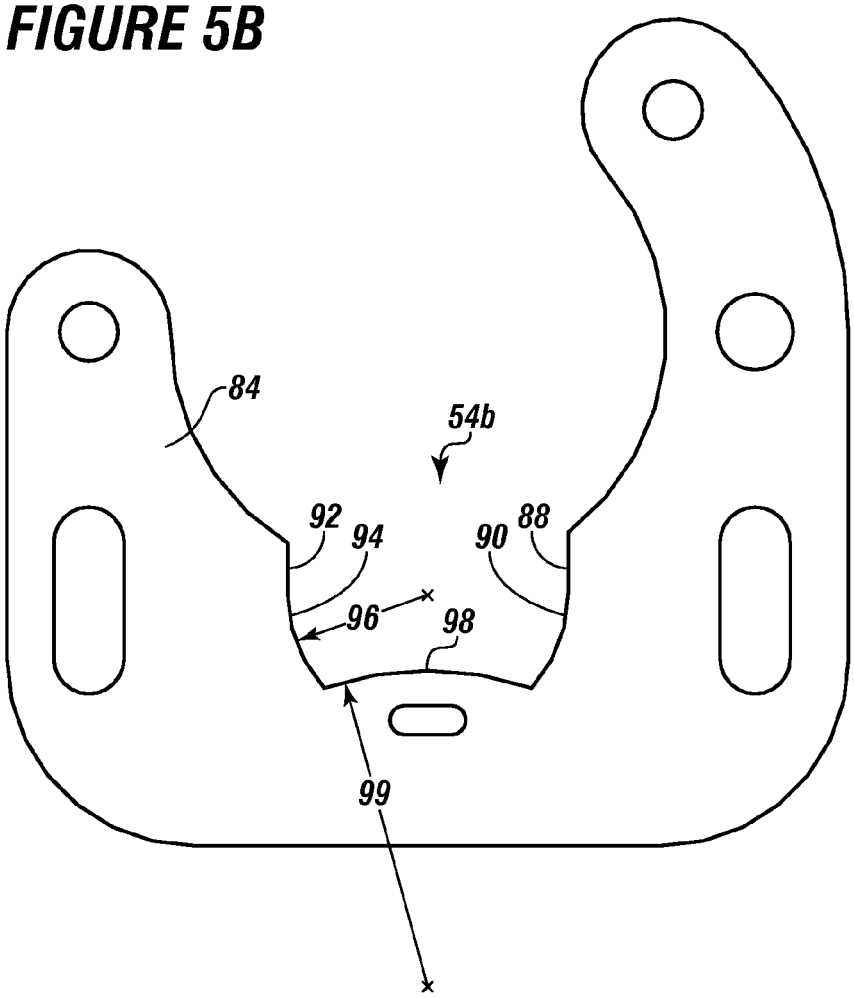
FIG. 5B depicts the fixed bottom plate according to one or more embodiments.

FIG. 5B depicts the fixed bottom plate according to one or more embodiments.

The fixed bottom plate 84 can have a fixed bottom rocker recess 54*b*.

The fixed bottom rocker recess 54*b* can have a first fixed bottom straight edge portion 88 sequentially connected with a first fixed bottom concave edge portion 90 and a second fixed bottom straight edge portion 92 sequentially connected with a second fixed bottom concave edge portion 94.

Each fixed bottom concave edge portion can have a fixed bottom concave edge radius 96.

The fixed bottom rocker recess 54*b* can have a fixed bottom convex edge 98 disposed between the first fixed bottom concave edge portion 90 and second fixed bottom concave edge portion 94 and connected therewith. The fixed bottom convex edge 98 can have a fixed bottom convex edge radius 99.

Figure 6:
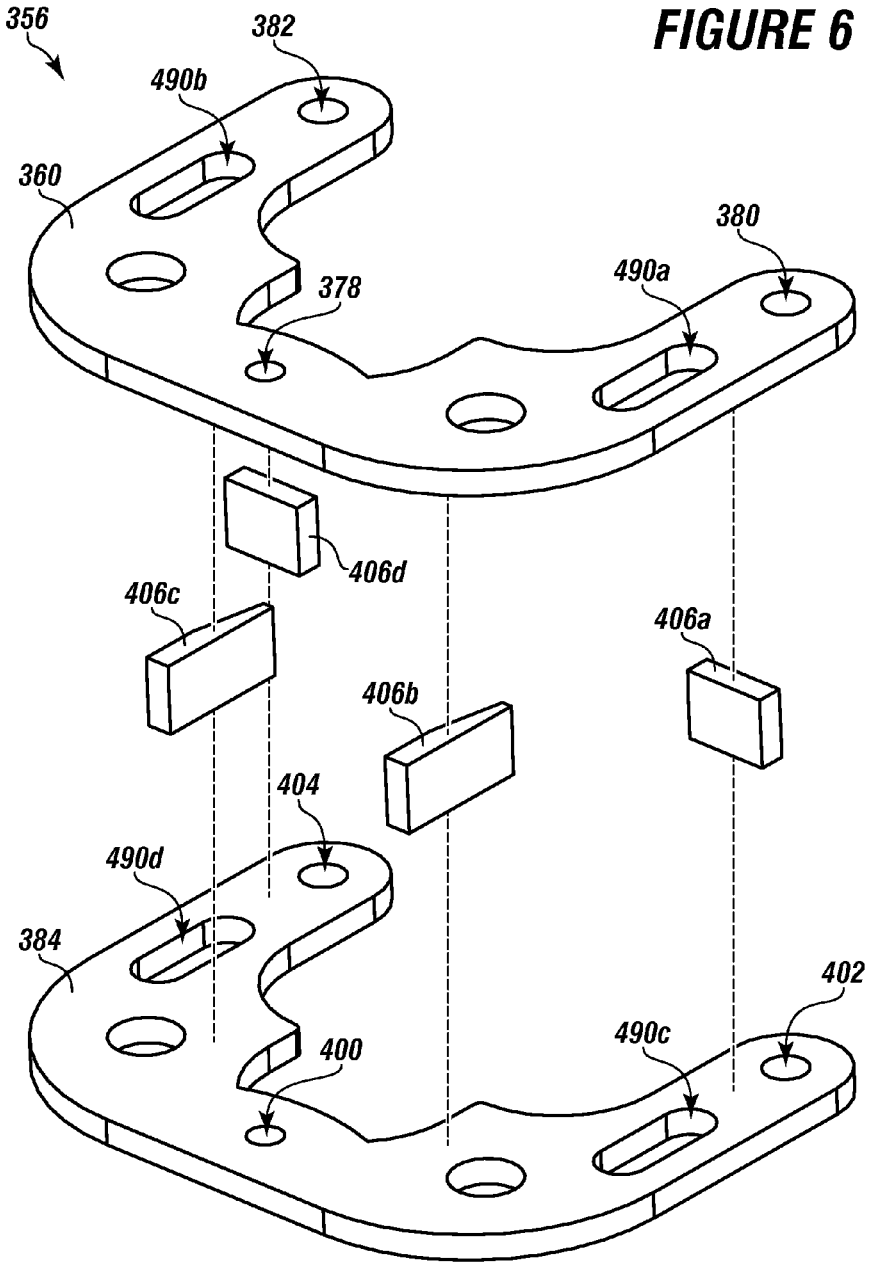
FIG. 6 depicts an exploded view of the adjustable gripping frame according to one or more embodiments.

FIG. 6 depicts an exploded view of the adjustable gripping frame 356 according to one or more embodiments.

The adjustable top plate 360 can have an adjustable top plate hinge opening 380 for receiving hinge pins, first adjustable gripping hole 490*a* and second adjustable gripping hole 490*b*, adjustable top plate locking opening 382 for receiving the locking pin, and adjustable top fastening hole 378 for receiving the plate jaw fastener.

The adjustable bottom plate 384 can have an adjustable bottom plate hinge opening 402*a* for receiving hinge pins, a third adjustable gripping hole 490*c* and fourth adjustable gripping hole 490*d*, adjustable bottom plate locking opening 404 for receiving the locking pin, and adjustable bottom fastening hole 400 for receiving the plate jaw fastener.

One or more adjustable spacing bars 406*a*, 406*b*, 406*c* and 406*d* can be disposed between the adjustable top plate 360 and adjustable bottom plate 384 for separating the adjustable top plate 360 and adjustable bottom plate 384.

The adjustable spacing bars 406*a*-406*d* can align the adjustable top fastening hole 378 with the adjustable bottom fastening hole 400, align the adjustable top plate hinge opening 380 with the adjustable bottom plate hinge opening 402, and align the adjustable top plate locking opening 382 with the adjustable bottom plate locking opening 404.

Figure 7A:
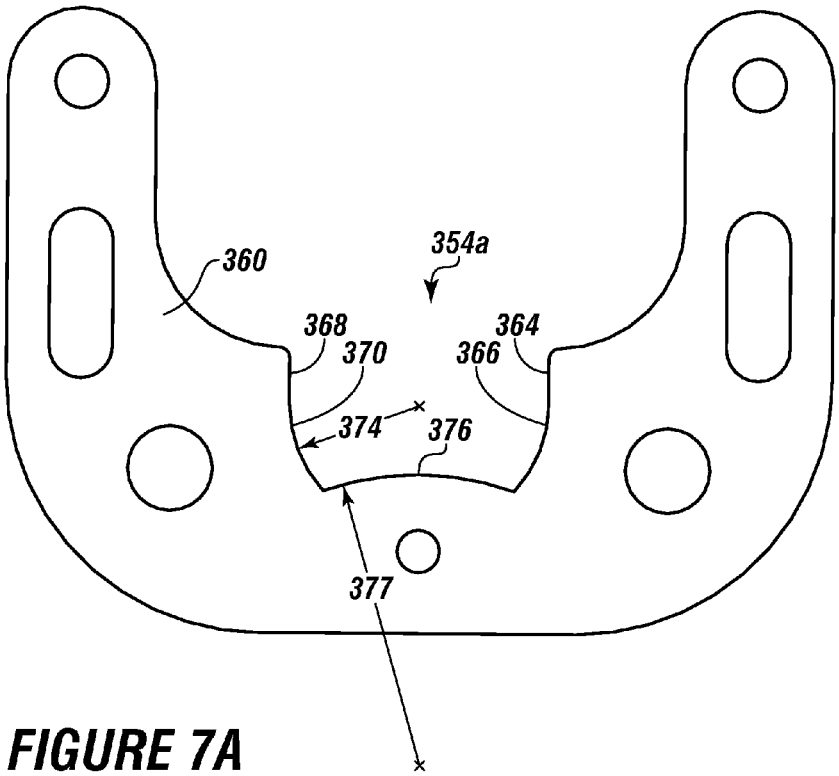
FIG. 7A depicts a detailed view of the adjustable top plate according to one or more embodiments.

FIG. 7A depicts a detailed view of the adjustable top plate according to one or more embodiments.

The adjustable top plate 360 can have the adjustable top rocker recess 354*a*.

The adjustable top rocker recess 354*a* can be configured to receive and retain the rocking jaw gripper rocker jaw.

For example, the adjustable top rocker recess 354*a* can have a first adjustable top straight edge portion 364 sequentially connected with a first adjustable top concave edge portion 366 and a second adjustable top straight edge portion 368 sequentially connected with a second adjustable top concave edge portion 370.

Each adjustable top concave edge portion can have an adjustable top concave edge radius 374.

The adjustable top rocker recess 354*a* can have an adjustable top convex edge 376 disposed between the first adjustable top concave edge portion 366 and second adjustable top concave edge portion 370 and connected therewith. The adjustable top convex edge 376 can have an adjustable top convex edge radius 377.

Figure 7B:
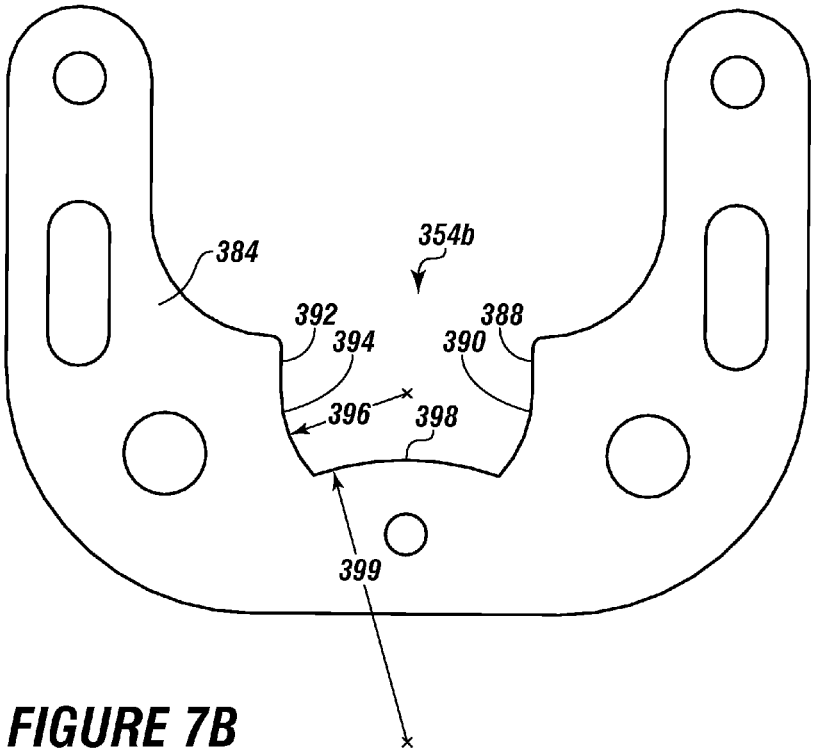
FIG. 7B depicts a detailed view of the adjustable bottom plate according to one or more embodiments.

FIG. 7B depicts a detailed view of the adjustable bottom plate according to one or more embodiments.

The adjustable bottom plate 384 can have the adjustable bottom rocker recess 354*b*.

The adjustable bottom rocker recess 354*b* can be configured to receive and retain the rocking jaw gripper rocker jaw.

The adjustable bottom rocker recess 354*b* can have a first adjustable bottom straight edge portion 388 sequentially connected with a first adjustable bottom concave edge portion 390 and a second adjustable bottom straight edge portion 392 sequentially connected with a second adjustable bottom concave edge portion 394.

Each adjustable bottom concave edge portions can have an adjustable bottom concave edge radius 396.

The adjustable bottom rocker recess 354*b* can have an adjustable bottom convex edge 398 disposed between the first adjustable bottom concave edge portion 390 and second adjustable bottom concave edge portion 394 and connected therewith. The adjustable bottom convex edge 398 can have an adjustable bottom convex edge radius 399.

Figure 8A:
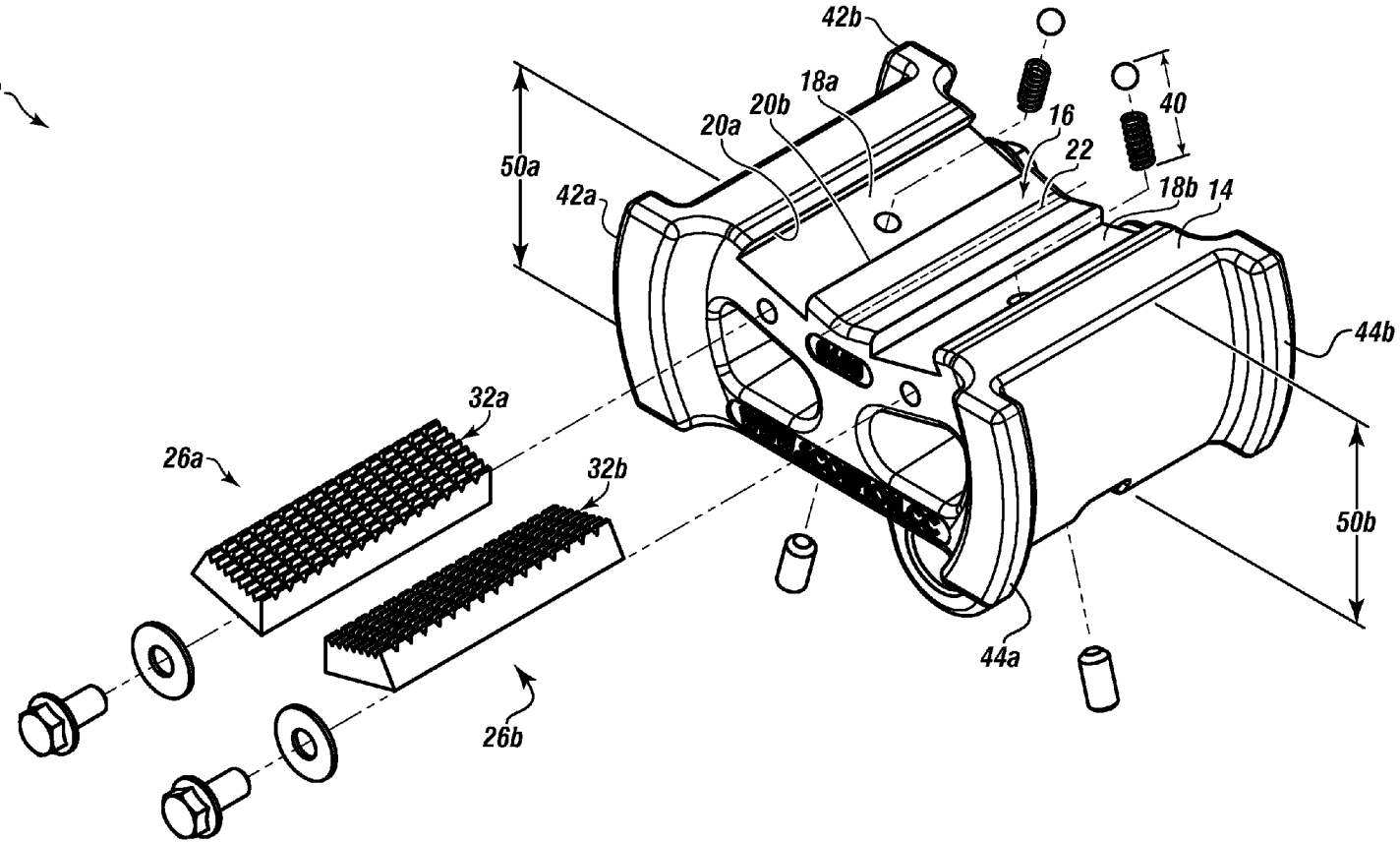
FIG. 8A depicts an exploded view of a two tong die rocker jaw according to one or more embodiments.

FIG. 8A depicts an exploded view of a two tong die rocker jaw according to one or more embodiments.

A rocking jaw gripper rocker jaw 12 can have a rocker jaw body 14. The rocker jaw body 14 can have a face 16.

The rocker jaw body 14 can have one or more tong die grooves 18*a* and 18*b* formed in the face 16. The tong die grooves 18*a* and 18*b* can have groove edges 20*a* and 20*b* that incline towards a center line 22 as the grooves edge extend from the rocker jaw body 14.

Though this embodiment is depicted with a v-shape and a center line, in another embodiment, the rocker jaw can be curved or flat.

The rocker jaw body 14 can have tong dies 26*a* and 26*b* in each of the tong die grooves 18. The tong dies 26*a* and 26*b* can have tooth beds 32*a* and 32*b*.

The rocker jaw body can have a holding means 40 for each tong die providing a holding compression to prevent the tong die from sliding out of the tong die groove.

The rocker jaw body can have a first pair of side flanges 42*a* and 42*b* extending from the rocker jaw body 14 and a second pair of side flanges 44*a* and 44*b* extending from the rocker jaw body 14. Each flange can be curved and resist deforming during movement.

The side of the rocker jaw body can have an outer radius 50*a* and 50*b* that provide a flush fit between the rocker jaw body and the rocker recess.

FIG. 8B depicts a close up view of a tong die according to one or more embodiments.

The tong die 26*a* can have the tooth bed 32*a*. The tooth bed 32*a* can support one or more teeth 34.

The tooth bed 32*a* can have tooth bed edges 36*a* and 36*b* each having a slope 38*a* and 38*b* to provide a flush fit with the groove edges.

FIG. 8C depicts a cut view of the tong die according to one or more embodiments.

The tong die 26*a* can have a back side depression 198, which can allow the tong die to be held by the holding means.

Figure 9:
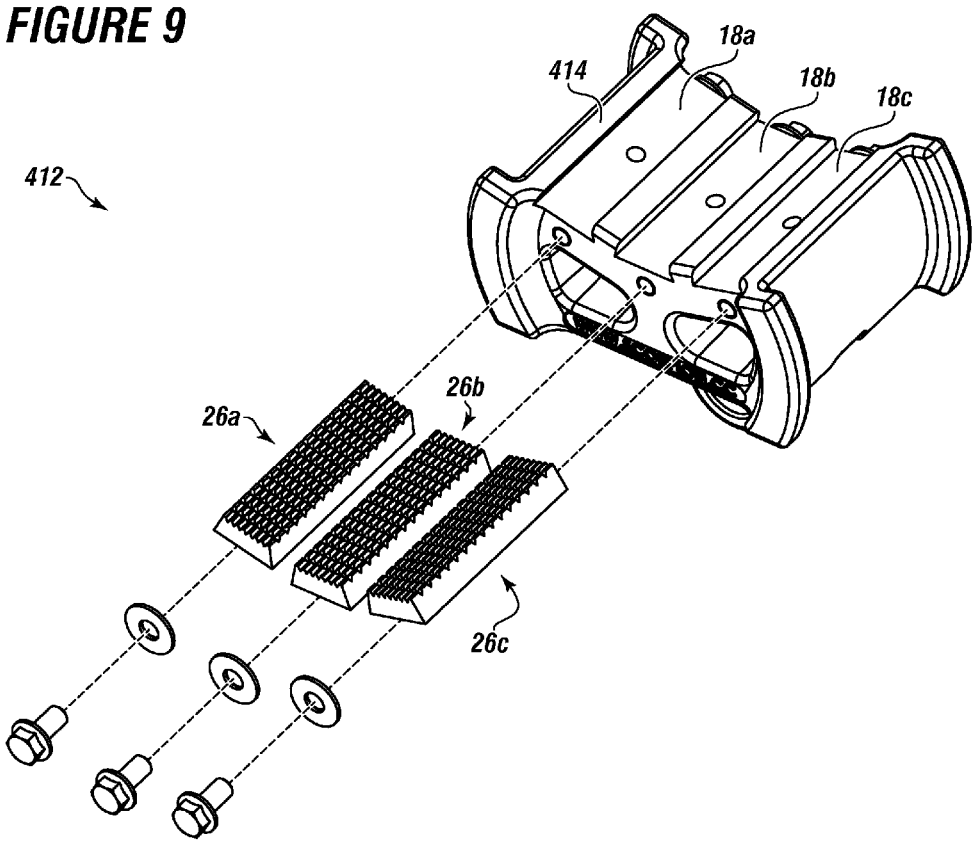
FIG. 9 depicts a three tong die rocker jaw according to one or more embodiments.

FIG. 9 depicts a three tong die rocker jaw according to one or more embodiments.

The three tong die rocker jaw 412 can have a rocker jaw body 414.

The three tong die rocker jaw 412 can have one or more tong die grooves 18*a*, 18*b* and 18*c* formed in a face of the rocker jaw body 414.

The rocker jaw body 414 can have a tong die 26*a*, 26*b* and 26*c* in each of the tong die grooves 18*a*, 18*b* and 18*c*.

While these embodiments have been described with emphasis on the embodiments, it should be understood that within the scope of the appended claims, the embodiments might be practiced other than as specifically described herein.

What is claimed is:

1. A rocking jaw gripper for restraining tubulars, the rocking jaw gripper comprising:

a. a first rocker arm jaw spaced apart from a second rocker arm jaw, wherein the first rocker arm jaw and the second rocker arm jaw comprise:

(i) a rocker jaw body comprising:

(a) a face having tong die grooves with groove edges; and (b) a tong die in each tong die groove;

(ii) a holding means for each tong die providing a holding compression to prevent the tong dies from sliding out of the tong die grooves;

(iii) a first pair of side flanges extending from the rocker jaw body and a second pair of side flanges extending from the rocker jaw body, wherein each side flange and is curved and is configured to prevent deformation during movement; and (iv) a tail extending from the rocker jaw body, wherein the tail has a tail hole;

b. an arm connected with the first rocker arm jaw;

c. a gripping frame connected with the arm, wherein the gripping frame comprises:

(i) a top plate with a top rocker recess, wherein the top rocker recess comprises:

(a) a first straight edge portion sequentially connected with a first concave edge portion having a first concave edge radius;

(b) a second straight edge portion sequentially connected with a second concave edge portion having a second concave edge radius; and (c) a top convex edge disposed between the first concave edge portion and the second concave edge portion, wherein the top convex edge has a top convex edge radius which is configured to allow pivoting of the rocker jaw;

(ii) a top fastening hole disposed proximate to the top rocker recess;

(iii) a top plate hinge opening disposed opposite a top plate locking opening formed in the top plate;

(iv) a bottom plate with a bottom rocker recess, wherein the bottom rocker recess comprises:

(a) a bottom first straight edge portion sequentially connected with a bottom first concave edge portion having a first bottom concave edge radius;

(b) a bottom second straight edge portion sequentially connected with a bottom second concave edge portion having a second bottom concave edge radius; and (c) a bottom convex edge disposed between the bottom first concave edge portion and the bottom second concave edge portion, wherein the bottom convex edge has a bottom convex radius which is configured to allow pivoting of the rocker jaw;

(v) a bottom fastening hole disposed proximate to the bottom rocker recess, wherein the second rocker arm is operatively aligned with the bottom fastening hole, wherein the top convex radius and the bottom convex radius allow for self-centering of the second arm rocker jaw in the top rocker recess and the bottom rocker recess;

(vi) a bottom plate hinge opening disposed opposite a bottom plate locking opening formed in the bottom plate; and (vii) spacing bars separating the top plate and the bottom plate, wherein the spacing bars align the top fastening hole with the bottom fastening hole, align the top plate hinge opening with the bottom plate hinge opening, and align the top plate locking opening with the bottom plate locking opening, and wherein the rocker jaw body has an outer diameter configured to provide a flush fit between the rocker jaw body and the top rocker recess and the bottom rocker recess;

d. a locking pin connecting the chain cylinder and the gripping frame through the top plate and the bottom plate;

e. a hinge pin connecting the arm with the gripping frame through the top plate and the bottom plate; and f. a plate jaw fastener retaining the rocker jaw body between the top plate and the bottom plate by engaging the tail hole of the rocker jaw body.

2. The rocking jaw gripper of claim 1, further comprising an adjuster link extending from the arm, wherein the gripping frame connects with the arm via:

a. one or more pins engaging through the adjuster link;

b. a bolt connecting the gripping frame to the arm, wherein the bolt extends through the adjuster link;

c. an adjuster nut securing the bolt to the adjuster link; and d. at least one aligning set screw for maintaining an orientation of the bolt in the adjuster link.

3. The rocking jaw gripper of claim 2, wherein the bolt comprises one or more alignment grooves for aligning the bolt in a proper orientation.

4. The rocking jaw gripper of claim 1, wherein the first pair of side flanges and the second pair of side flanges each have bevels at a base thereof allowing the rocker jaw to move in the gripping frame to hold the tubulars during make-up and break-out.

5. The rocking jaw gripper of claim 1, wherein the gripping frame connects with the arm using an L-link.

6. The rocking jaw gripper of claim 1, wherein the face comprises three parallel tong die grooves and a tong die in each parallel tong die groove.

7. The rocking jaw gripper of claim 1, wherein the holding means is a detent or a fastener.

8. The rocking jaw gripper of claim 1, wherein the first pair of side flanges and the second pair of side flanges are connected with an outside surface of the top plate and the bottom plate or connected with the an inside surface of the top plate and the bottom plate.

9. The rocking jaw gripper of claim 1, further comprising at least one gripping hole disposed in the top plate and the bottom plate.

10. The rocking jaw gripper of claim 1, further comprising a locking pin storage hole disposed through the top plate and the bottom plate for containing the locking pin.

11. The rocking jaw gripper of claim 1, further comprising one or more hinge points disposed on the top plate opposite the top plate locking opening and disposed on the bottom plate opposite the bottom plate locking opening.

12. The rocking jaw gripper of claim 1, wherein the top plate and bottom plate each comprise one or more locking openings disposed opposite one or more hinge points.

13. The rocking jaw gripper of claim 1, further comprising at least two handles mounted to the rocking jaw gripper.

14. The rocking jaw gripper of claim 1, wherein the rocker jaw body further comprises:

a. a first body cavity and a second body cavity extending from a top side into the rocker jaw body; and b. a third body cavity and a fourth body cavity extending from a bottom side into the rocker jaw body.

15. The rocking jaw gripper of claim 1, wherein each tong die further comprises a depression in a back side thereof for containing the holding means.

* * * * *